US009726446B2

(12) United States Patent
Wong et al.

(10) Patent No.: US 9,726,446 B2
(45) Date of Patent: Aug. 8, 2017

(54) MAGAZINE FOR PROJECTILE LAUNCHER

(71) Applicant: Big Monster Toys, LLC, Chicago, IL (US)

(72) Inventors: Chun Wing Wong, Hong Kong (CN); Kin Fai Chang, Hong Kong (CN); Zgiant Zheng, Guangdong (CN); Ying Si Lui, Hong Kong (CN); Donald A. Rosenwinkel, Chicago, IL (US); Todd J. Kurtzer, Evanston, IL (US); Richard Blake Kuralt, Chicago, IL (US); David Strom, Redondo Beach, CA (US)

(73) Assignee: Big Monster Toys, LLC, Chicago, IL (US)

( * ) Notice: Subject to any disclaimer, the term of this patent is extended or adjusted under 35 U.S.C. 154(b) by 0 days.

(21) Appl. No.: 14/907,469

(22) PCT Filed: Jul. 25, 2014

(86) PCT No.: PCT/US2014/048191

§ 371 (c)(1),
(2) Date: Jan. 25, 2016

(87) PCT Pub. No.: WO2015/013610

PCT Pub. Date: Jan. 29, 2015

(65) Prior Publication Data

US 2016/0187085 A1 Jun. 30, 2016

Related U.S. Application Data

(60) Provisional application No. 61/859,088, filed on Jul. 26, 2013.

(51) Int. Cl.
*F41B 11/00* (2013.01)
*F41A 9/25* (2006.01)
(Continued)

(52) U.S. Cl.
CPC ..... *F41A 9/25* (2013.01); *F41B 11/55* (2013.01); *F41B 11/642* (2013.01); *F41B 11/646* (2013.01); *F41B 11/681* (2013.01)

(58) Field of Classification Search
CPC ..... F41B 11/55; F41B 11/50
See application file for complete search history.

(56) References Cited

U.S. PATENT DOCUMENTS 2,237,678 A * 4/1941 Lohr ..... F41A 9/28 124/44.7
4,986,251 A * 1/1991 Lilley ..... F41B 11/55 124/48

(Continued)

FOREIGN PATENT DOCUMENTS

WO WO2009/025889 * 2/2009

OTHER PUBLICATIONS

International Search Report (this case) Oct. 23, 2014.
International Opinion (this case) Oct. 23, 2014.

*Primary Examiner* — John Ricci
(74) *Attorney, Agent, or Firm* — Clifford H. Kraft

(57) ABSTRACT

A magazine configured to hold a plurality of projectiles is disclosed. The magazine can be used with a toy projectile launcher. A toy projectile launcher configured to launch a plurality of projectiles therefrom is also disclosed. The toy projectile launcher having: a housing; and a magazine movably secured to a housing of the toy projectile launcher, the magazine including a plurality of chambers, each of the chambers being configured to hold one of the plurality of the projectiles therein, the magazine having a surface that is engageable by the toy projectile launcher to align and to move the magazine relative to the housing.

17 Claims, 15 Drawing Sheets

(51) Int. Cl.

| | |
|---|---|
| ***F41B 11/55*** | (2013.01) |
| ***F41B 11/642*** | (2013.01) |
| ***F41B 11/646*** | (2013.01) |
| ***F41B 11/681*** | (2013.01) |

(56) References Cited

U.S. PATENT DOCUMENTS

| | | | | |
|---|---|---|---|---|
| 5,522,374 | A * | 6/1996 | Clayton | F41B 11/54 124/48 |
| 5,592,931 | A * | 1/1997 | Johnson | F41B 11/54 124/48 |
| 2013/0068207 | A1 | 3/2013 | Chu | |

* cited by examiner

MAGAZINE FOR PROJECTILE LAUNCHER

RELATED APPLICATION

This application claims priority to U.S. Provisional Patent Application No. 61/859,088, filed Jul. 26, 2013, entitled "Magazine for Projectile Launcher," the entire disclosure of which is incorporated by reference herein.

BACKGROUND

Various embodiments of the present invention relate to a toy projectile launcher or dart launching mechanism and a magazine for holding the darts or projectiles to be launched therefrom. In particular, the present invention relates to a magazine having various features.

Darts or toy projectiles have been used in toy blasters or other toys to provide an enhanced play factor to the toy blasters or toys. Some toy blasters are configured to launch multiple darts or projectiles sequentially.

Accordingly, it is desirable to provide a toy projectile launcher that has a safety mechanism and improvements to the operation thereof. There is a need for a magazine for a projectile launcher that can contain multiple darts or toy projectiles.

SUMMARY OF THE INVENTION

In one embodiment, a toy is provided. The toy being configured to launch a plurality of projectiles from a magazine configured to hold the plurality of the projectiles therein. The magazine being movably coupled to the toy.

In another embodiment, a magazine configured to removably receive a plurality of projectiles therein and configured for use with a toy configured to launch the plurality of projectiles therefrom is provided. The magazine having: a main body portion, which is secured to a back body portion and wherein the back body portion has a first plurality of features and a second plurality of features located on opposite sides of a plurality of openings, wherein each one of the plurality of openings is fluidly connected to at least one of a plurality of chambers of the magazine, wherein each one of the plurality of chambers is configured to receive one of the plurality of projectiles therein In one embodiment, a toy projectile launcher configured to launch a plurality of projectiles therefrom, the toy projectile launcher comprising: a housing; and a magazine movably secured to a housing of the toy projectile launcher, the magazine including a plurality of chambers, each of the chambers being configured to hold one of the plurality of the projectiles therein, the magazine having a surface that is engageable by the toy projectile launcher to align and to move the magazine relative to the housing.

In one alternative implementation, the magazine has a main body portion and a back body portion, the main body portion being coupled to the back body portion.

In one alternative implementation, wherein the magazine further comprises: a gasket located between the main body portion and the back body portion.

In one alternative implementation, the main body portion has a receiving area, the gasket being located in the receiving area.

In one alternative implementation, the toy projectile launcher includes an advancing member, and the back body portion has a first plurality of recesses that are engageable by the advancing member to cause movement of the magazine relative to the housing.

In one alternative implementation, the back body portion has a second plurality of recesses formed therein spaced apart from the first plurality of recesses.

In one alternative implementation, the toy projectile launcher includes a spring-biased mechanism, the second plurality of recesses being configured to receive the spring-biased mechanism, the spring-biased mechanism locating the magazine with respect to the housing such that a nozzle of the toy projectile launcher is fluidly coupled to one of a plurality of openings located between the first plurality of recesses and the second plurality of recesses.

In one alternative implementation, each of the plurality of first recesses has an angled portion that terminates at a flat portion, the angled portion being configured to allow the advancing member to slide along a surface of the angled portion and engage the flat portion in order to move the magazine with respect to the housing.

In one alternative implementation, the back body portion includes a plurality of protruding members, each of the protruding members being received within one of the plurality of projectiles when the projectiles are inserted into the chambers of the magazine.

In one alternative implementation, the chambers are arranged into two columns, and the columns are offset from each other.

In one alternative implementation, the magazine includes a plurality of through holes formed therein, and each of the chambers is coupled to one of the holes.

In one alternative implementation, the holes are located in a line.

In one alternative implementation, the holes are located between a pair of lines of recesses.

In another embodiment, a magazine for a toy projectile launcher configured to launch a plurality of projectiles therefrom, the magazine comprising: a main body portion including walls defining a plurality of chambers, each of the chambers being configured to hold the plurality of the projectiles therein; and a back body portion coupled to the main body portion, the back body portion being engageable by the toy projectile launcher to move the magazine.

In one alternative implementation, the back body portion includes a first row of recesses that are engageable by an advancing member of the toy projectile launcher, and a second row of recesses that are engageable by a locating member of the toy projectile launcher.

In one alternative implementation, the magazine includes a plurality of through holes formed therein, each of the chambers is coupled to one of the holes, and the holes are located between the two rows of recesses.

In one alternative implementation, the chambers are arranged into two columns, and the columns are offset from each other.

In another embodiment, a magazine is configured to removably receive a plurality of projectiles therein and configured for use with a toy projectile launcher configured to launch the plurality of projectiles therefrom, the magazine comprising: a main body portion, which is secured to a back body portion and wherein the back body portion has a first plurality of features and a second plurality of features located on opposite sides of a plurality of openings, wherein each one of the plurality of openings is fluidly connected to at least one of a plurality of chambers of the magazine, wherein each one of the plurality of chambers is configured to receive one of the plurality of projectiles therein.

In one alternative implementation, the chambers are arranged into two columns each being offset from the other.

In one alternative implementation, adjacent chambers share common walls.

In various embodiments and implementations of the invention, the magazine can be used with different toy projectile launchers. The magazine can be advanced by the toy projectile launcher.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

Figure 1A:
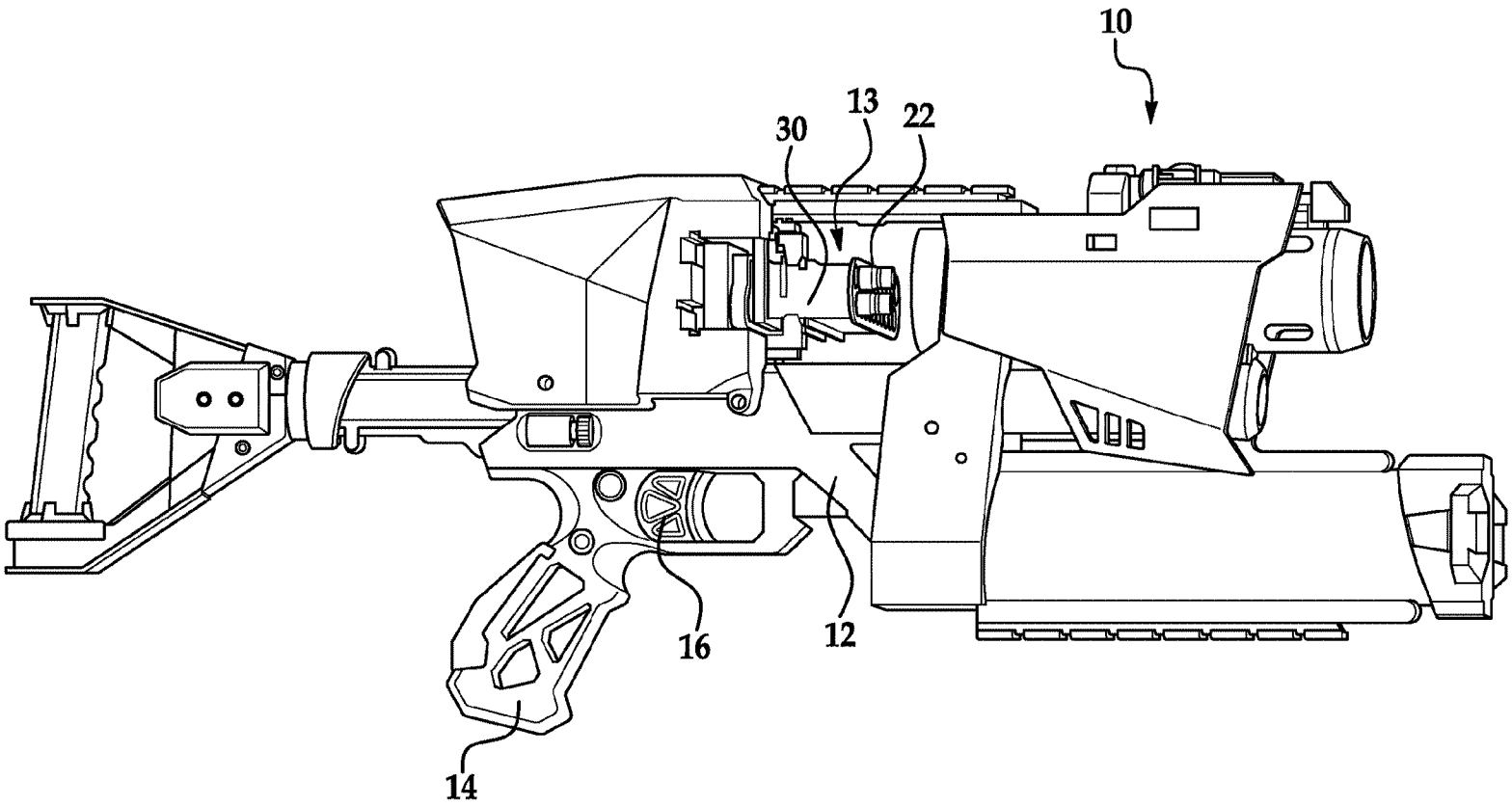
FIG. 1A is a perspective view of a device for launching a dart or projectile in accordance with an exemplary embodiment of the present invention.
Figure 1B:
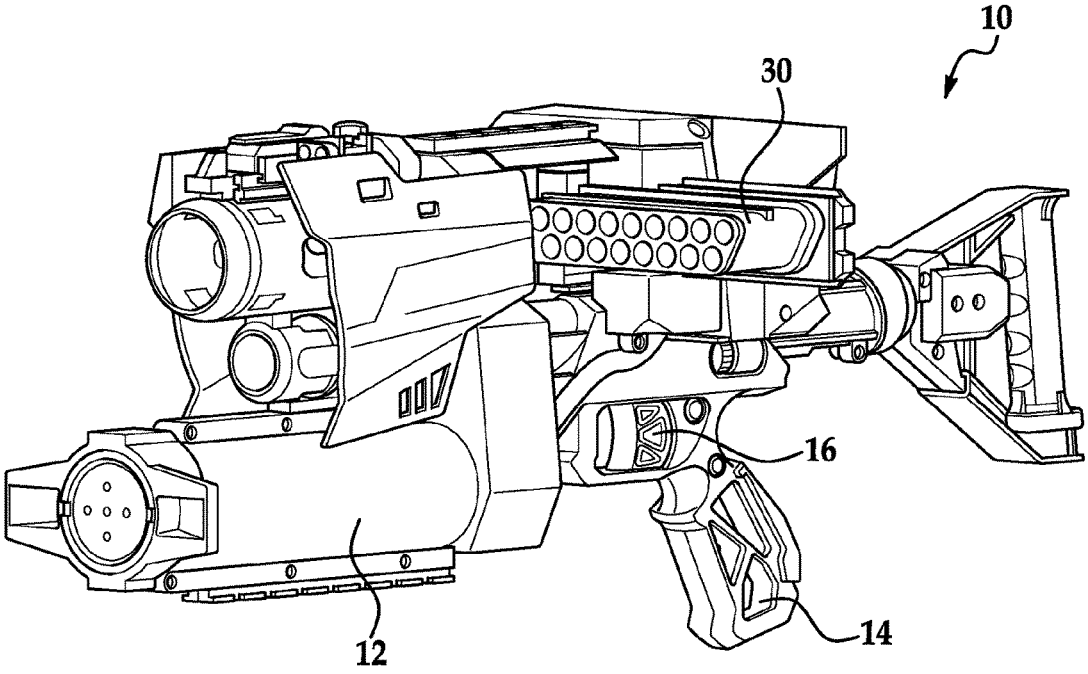
FIG. 1B is a perspective view of the device illustrated in FIG. 1A.

Although the drawings represent varied embodiments and features of the present invention, the drawings are not necessarily to scale and certain features may be exaggerated in order to illustrate and explain exemplary embodiments the present invention. The exemplification set forth herein illustrates several aspects of the invention, in one form, and such exemplification is not to be construed as limiting the scope of the invention in any manner.

DETAILED DESCRIPTION

Referring now to the FIGS., a toy, device, toy blaster or apparatus 10 for launching a toy projectile constructed in accordance with various non-limiting exemplary embodiments of the present invention is illustrated. The apparatus 10 illustrated in the FIGS. is one embodiment of an apparatus that can be used with a magazine according to the invention. It is contemplated that other embodiments of an apparatus 10 can be used with the magazine disclosed herein.

Toy, device, toy blaster or apparatus 10, hereinafter referred to as toy 10 comprises a main housing 12. Housing 12 includes a passageway 13 extending through the housing 12 that accommodates a magazine 30 containing one or more projectiles and allows the magazine 30 to advance therethrough. Housing 12 also has a grip portion 14 and an actuation or trigger mechanism 16. The actuation or trigger mechanism 16 is movably mounted to the housing 12. Movement or operation of the actuation or trigger mechanism 16 operates various components of the toy 10. For example, movement of actuation mechanism 16 will in one embodiment, cause compressed air or fluid to be released or transferred to an operating device or engine (not shown) in order to active the same. In one non-limiting exemplary embodiment, the operating device may be a pneumatically driven operating device. In another embodiment, movement of a trigger mechanism 16 releases a spring-loaded piston that can be released to compress air in the apparatus 10 to launch projectiles 22.

Operation of the operating device ultimately causes a projectile or dart 22 to be launched from the toy. In accordance with an exemplary embodiment of the present invention, the projectile or dart 22 that is launched is aligned with a nozzle 24 (see FIG. 3A) such that compressed air from a cylinder of the operating device is directed into a particular chamber 28 of a magazine 30 in which a projectile 22 is located such that the projectile 22 can be launched therefrom.

Figure 2:
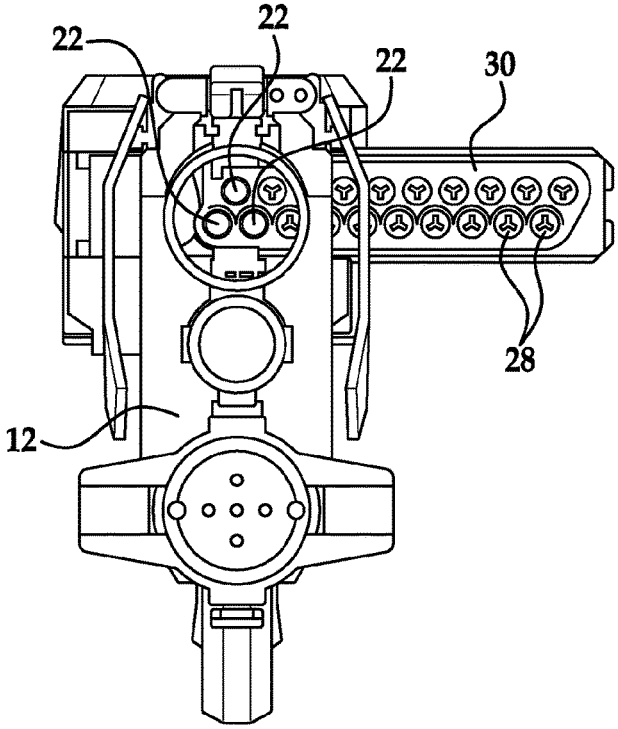
FIG. 2 is front view of the device illustrated in FIG. 1A.

The magazine 30 is slidably or movably secured to the toy 10 so that different projectiles 22 in chambers 28 of the magazine 30 can be aligned to be launched from the toy 10. Referring to FIG. 2, a front view of the toy 10 is illustrated. As shown, a few projectiles 22 are illustrated in different chambers 28 of the magazine 30.

Figure 3A:
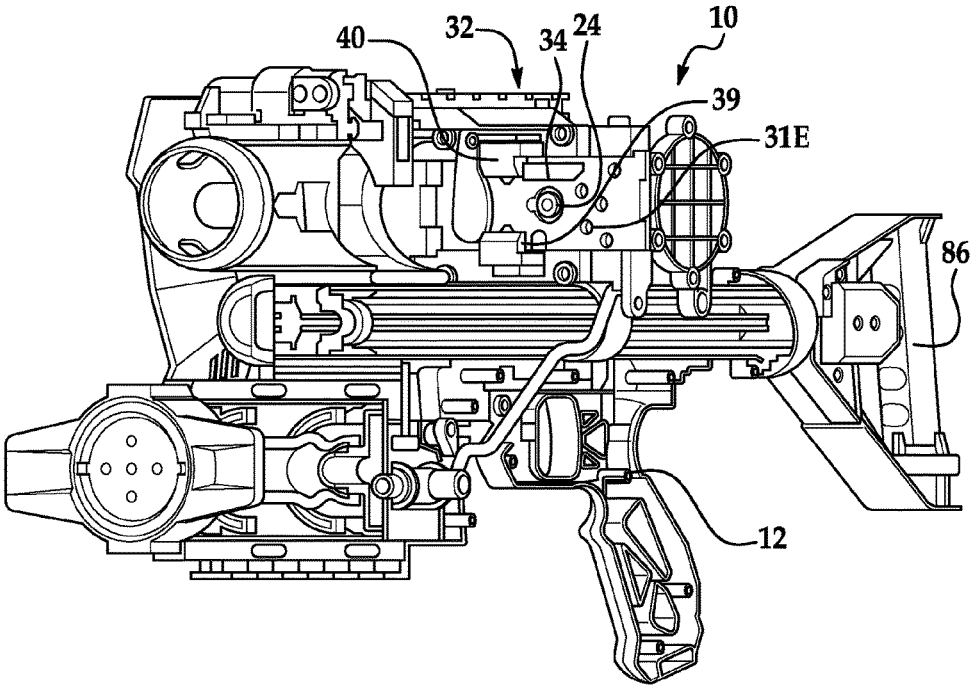
FIGS. 3A-3C are interior views of the device illustrated in FIG. 1A, wherein outer portions have been removed.

Referring to FIG. 3A, lever arm assemblies 39 and 40 are positioned to be on opposite sides of a magazine 30 inserted into the opening 13. The lever arm assemblies 39 and 40 are used to detect the presence of projectiles 22 in the magazine 30.

Figure 3B:
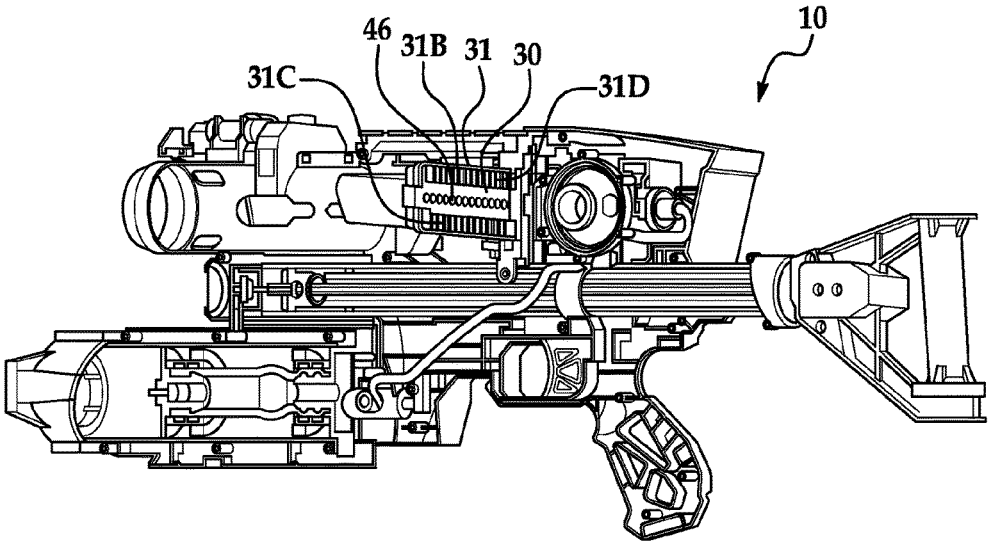
Figure 3C:
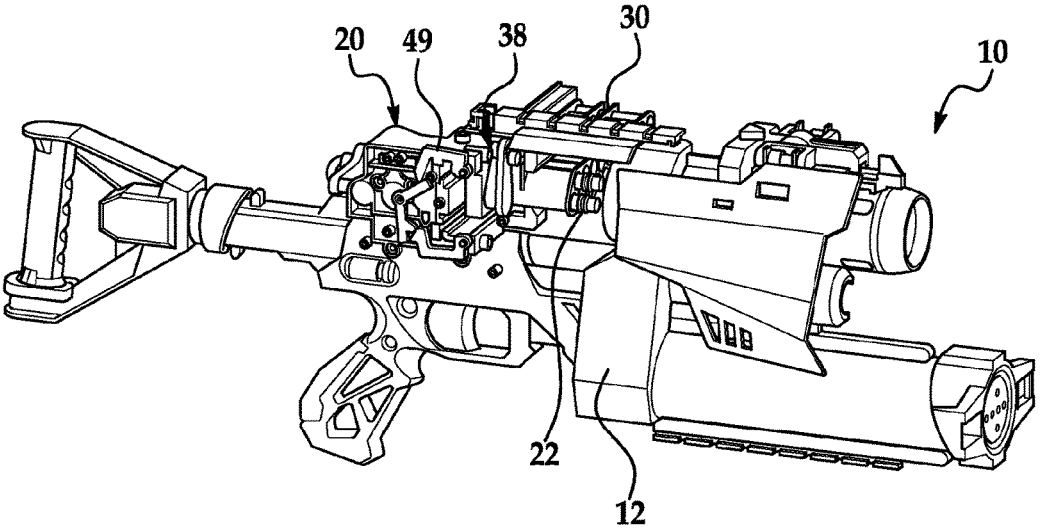

Referring to FIG. 3B, the base 31 of the magazine 30 is illustrated. As shown, the bottom surface 31D of the base 31 includes a centrally located row of openings 46, each of which is in fluid communication with one of the chambers 28. The bottom surface 31D includes two parallel rows of notches or recesses formed therein as well. The notches can be referred to alternatively as features. Notches 31B are used to advance the magazine 30 relative to the toy blaster 10. Notches 31C are used to position the magazine 30 relative to the air source or nozzle. A spring-biased positioner 31E (shown in FIG. 3A) engages a notch 31C to ensure that the proper opening 46 is in position to fire one of the projectiles 22.

Figure 8:
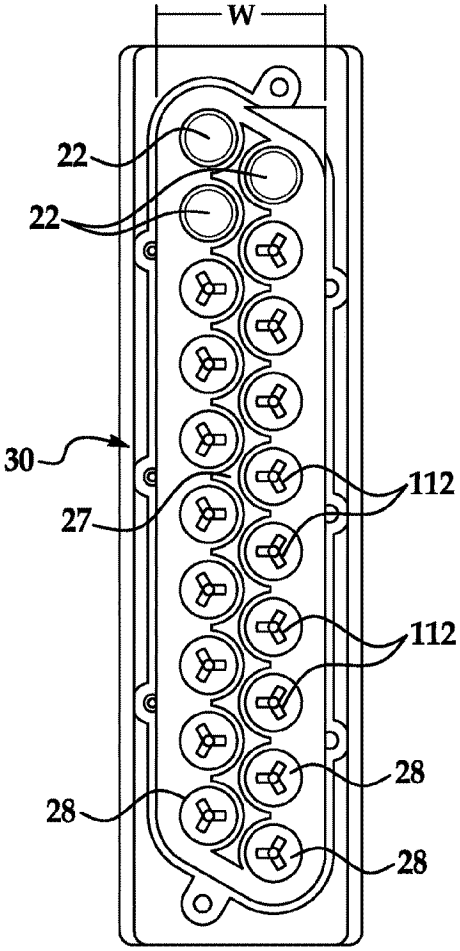
FIG. 8 is a front view of the magazine.
Figure 11:
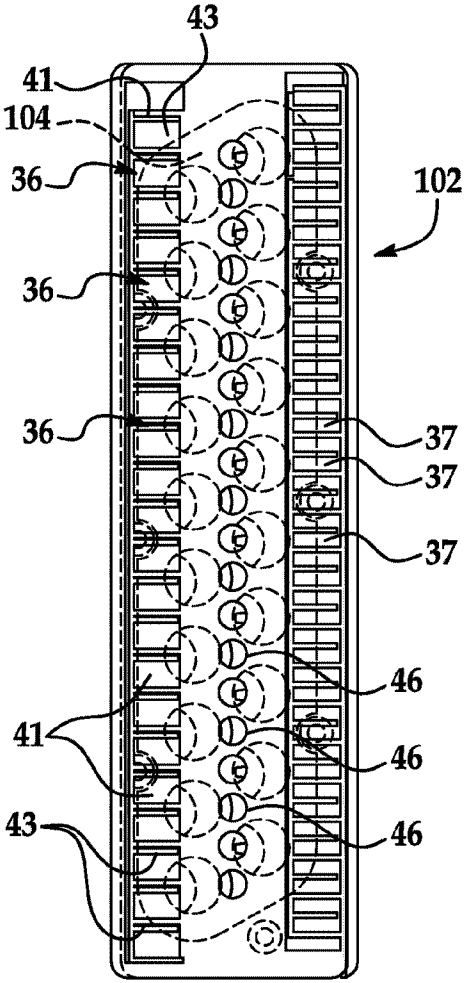
FIGS. 10 and 11 are rear views of the magazine.
Figure 10:
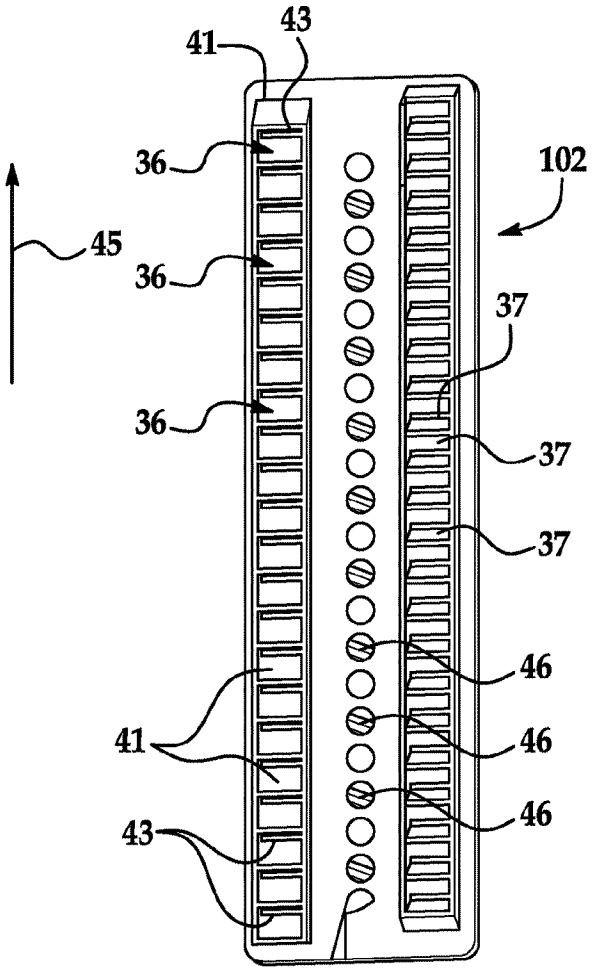

As shown in the FIGS. (such as FIG. 8), the chambers 28 are proximate to each other. In this embodiment, the chambers 28 are in two rows and are slightly offset from each other so that a chamber in one row can be brought very close to two adjacent chambers in the other row. The rows may be referred to alternatively as columns. In one embodiment, proximate chambers share common walls between them. In the illustrated embodiment, to make the magazine 30 lighter and reduce the overall material used, gaps or spaces 27 (see FIG. 8) are provided between the rows of chambers 28. The common walls and the proximity of the chambers 28 to each other reduces the overall size of the magazine and allow for the inlet openings 46 to be positioned in a single row along the back body portion of the magazine 30. The single line of centrally located openings 46 simplifies the functioning of the toy blaster 10 because the port on the blaster 10 through which fluid flows to the magazine 30 to launch a projectile 22 can remain stationary and does not need to move (such as up or down) to be positioned to launch projectiles in different chambers sequentially.

In one non-limiting embodiment, the magazine 30 is configured such that magazine 30 moves in a linear direction with respect to the toy 10 to position projectiles 22 for firing in a sequential manner. The movement of the magazine 30 with respect to housing 12 of the toy 10 is also achieved via movement of actuation mechanism 32, which is also activated or operated by the operating device 20.

Referring to FIG. 3A, the actuation mechanism 32 has an advancing member 34, which is movably mounted to the toy 10 or housing 12 and is configured to engage one of the notches 31B of the base 31 of the magazine 30. As described in greater detail below, each of the notches 31B includes a pair of walls that are angled so that the advancing member 34 pushes on one of the walls to move the magazine 30 with respect to the housing 12 of the toy 10.

In one embodiment, the movement of the magazine with respect to the housing 12 occurs after launching of a projectile 22 from the toy 10. Accordingly, the magazine 30 will advance so that a new projectile 22 is aligned with nozzle 24 such that this projectile 22 is now ready to be launched from the toy 10. Accordingly, movement of actuation mechanism 32 causes slidable movement of the magazine 30 respect to the toy 10.

Figure 4A:
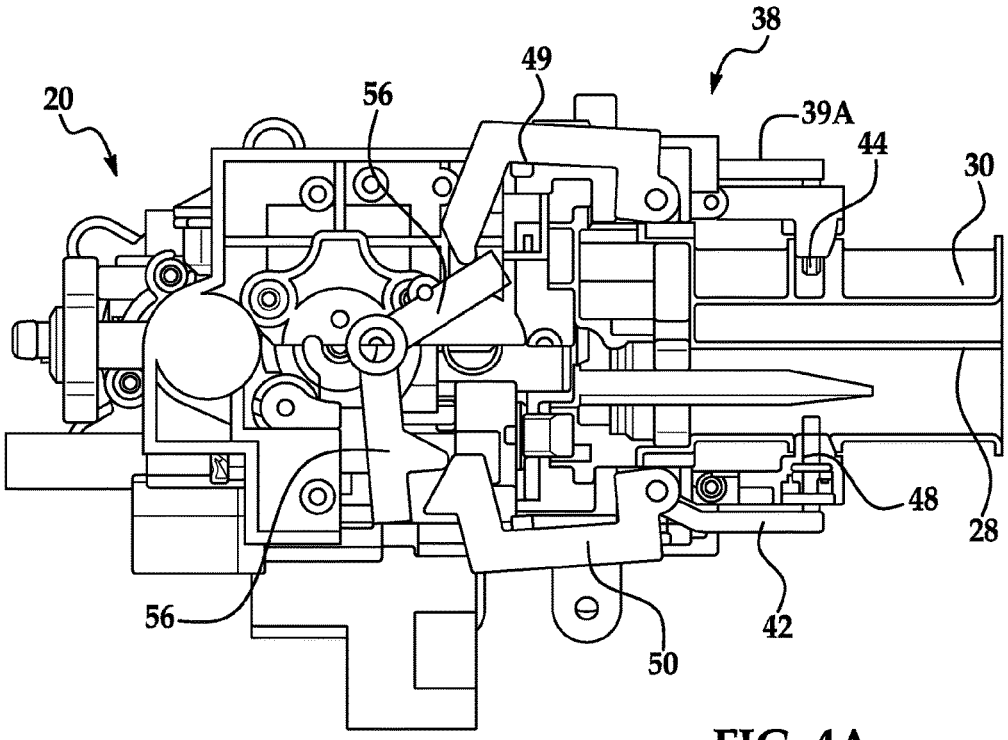
FIGS. 4A-4B are side views of the device illustrated in FIG. 1A with a magazine.

In order to provide toy 10 with a mechanism for launching only a predetermined type of projectile 22 from toy 10, a safety mechanism 38 is provided. In accordance with an exemplary embodiment of the present invention, as shown in FIG. 4A, safety mechanism 38 comprises a first lever 40 and a second lever 42 each being pivotally mounted to the toy 10 such that a first contact portion 44 of the first lever 40 is positioned to make contact with the projectile 22 when it is properly inserted into a chamber 28 of the magazine 30 that is in fluid communication with nozzle 24 via one of a plurality of openings 46 in the magazine 30. Similarly, while a second contact portion 48 of the second lever 42 is positioned to make contact with projectile 22 when it is properly inserted into a chamber 28 of the magazine 30 that is in fluid communication with nozzle 24 through one of the plurality of openings 46 in the magazine 30. Each of the first lever 40 and the second lever 42 is biased by springs so that the first contact portion 44 and the second contact portion 48 are continuously in engagement with the magazine and are continuously biased into openings 46 between the rails 114 (see FIG. 5) on each side of the magazine 30.

As shown in at least FIGS. 1A, 1B, 2, 5, 8A and 8B, the chambers 28 of the magazine 30 are offset from each other such that only one of the plurality of chambers 28 can be fluidly coupled to the nozzle 24 as the magazine 30 slides with respect to the toy 10. When a chamber 28 having a projectile 22 inserted therein is aligned or coupled with nozzle 24, a portion of the projectile 22 will contact either the first contact portion 44 or the second contact portion 48, thereby causing pivotal movement of the corresponding one of the first lever 40 or the second lever 42.

Figure 4B:
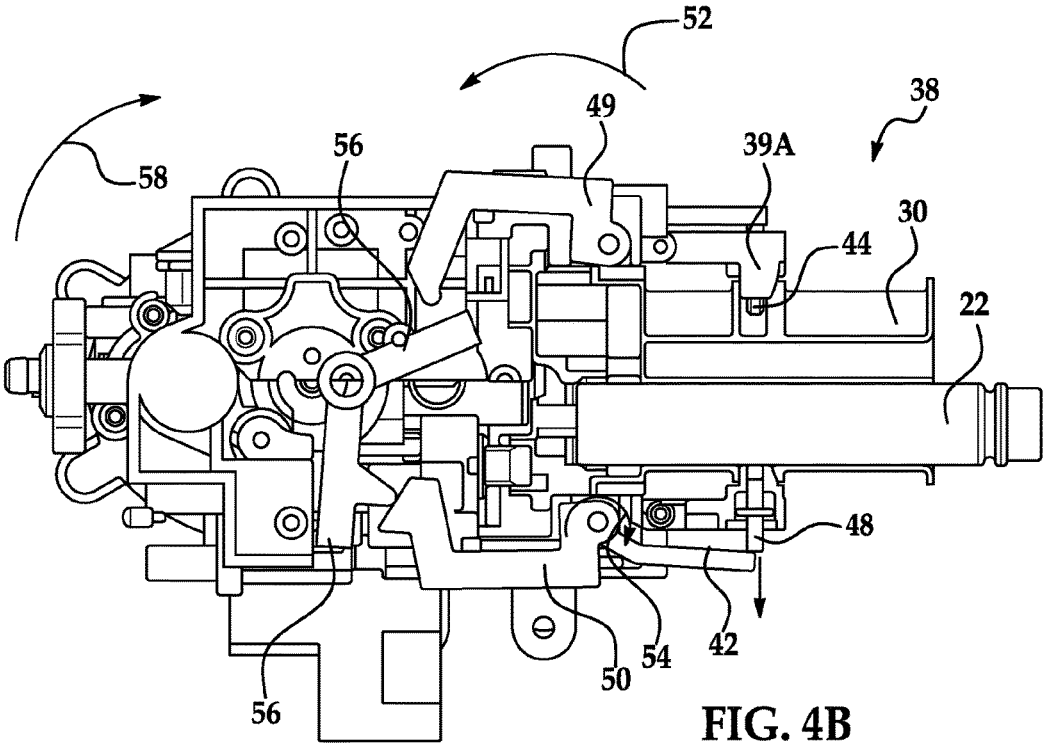

Movement of the first lever 40 causes a corresponding movement of a member 49 coupled to the first lever 40 while movement of the second lever 42 causes corresponding movement of a member 50 coupled to the second lever 42. Movement of member 49 in the direction of arrow 52 or member 50 in the direction of arrow 54 causes a corresponding movement of a member 56 in the direction of arrow 58. When 56 moves in the direction of arrow 58, it moves from a first position (see at least FIG. 4A) to a second position (see at least FIG. 4B). The first position prevents compressed air from entering into nozzle 24 because the operating mechanism of the toy projectile launcher 10 is prevented while the second position allows compressed air to enter into nozzle 24 and thus allow a projectile 22 to be launched from the magazine 30.

Figure 5:
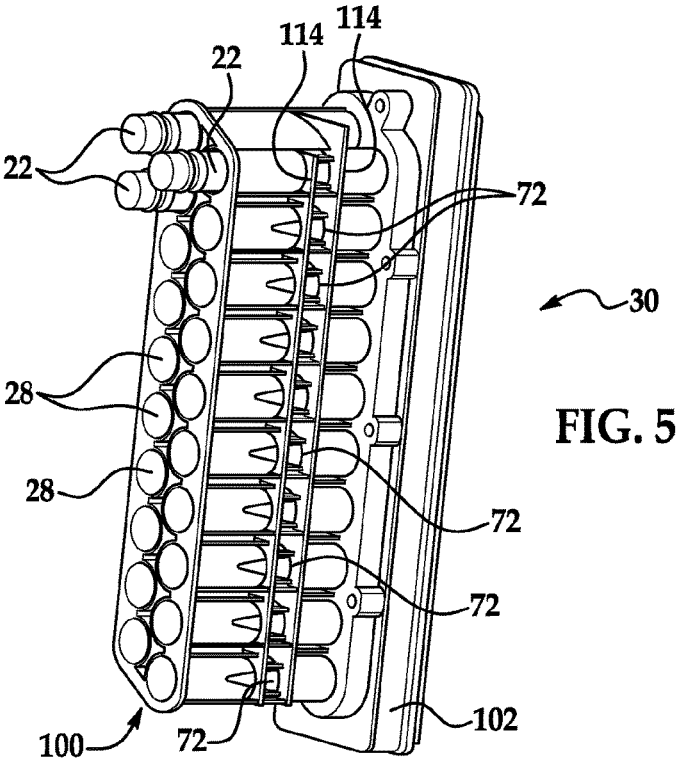
FIG. 5 is a perspective view of a magazine contemplated for use with the device in accordance with an exemplary embodiment of the present invention.

Referring to FIGS. 5-12, various views of an embodiment of a magazine 30 according to the present invention are illustrated. As mentioned above, magazine 30 is configured for use with toy 10 and interaction with the safety mechanism 38. Referring to FIG. 5, in one embodiment of the invention, each chamber 28 of magazine 30 has an outer wall that includes a slot or opening 72 formed therein. The opening 72 extends through the outer wall. In addition, a pair of rails or guides 114 are located along each of the opposite sides of the magazine 30 and on opposite sides of the openings 72.

The openings 72 are located on opposite sides of the magazine and are configured to allow either the first contact portion 44 of the first lever 40 or the second contact portion 48 of the second lever 42 to contact an exterior surface of the projectile 22 when the projectile 22 is inserted into a chamber 28 that is fluidly coupled to nozzle 24.

As illustrated, the magazine 30 has a main body portion 100, which is secured to a back body portion 102. In one embodiment, a gasket 104 may be located between main body portion 100 and back body portion 102. As shown in at least FIG. 9A, the main body portion 100 has a receiving area 106 configured for receipt of gasket 104 therein. Also shown is a plurality of features or protrusions 108 that are configured to be received within complementary openings 110 of gasket 104. The gasket 104 also includes larger openings that are aligned with the chambers 28 formed in the main body portion 100.

Back body portion 102 has a plurality of notches or recesses 36 that are configured to be engaged by advancing member 34, which moves in and out relative to housing 12 of toy blaster 10, to cause a corresponding movement of magazine 30 with respect to housing 12 of the toy 10. The notches 36 can be referred to as advancing notches.

In addition, back body portion 102 has a plurality of other notches or recesses 37 that are configured to interact with or receive a spring-biased mechanism 39 therein. Spring-biased mechanism 39 is configured to locate magazine 30 with respect to toy 10 such that nozzle 24 is fluidly coupled to one of the openings 46 located between the rows of notches 36 and 37 of back body portion 102.

Figure 12:
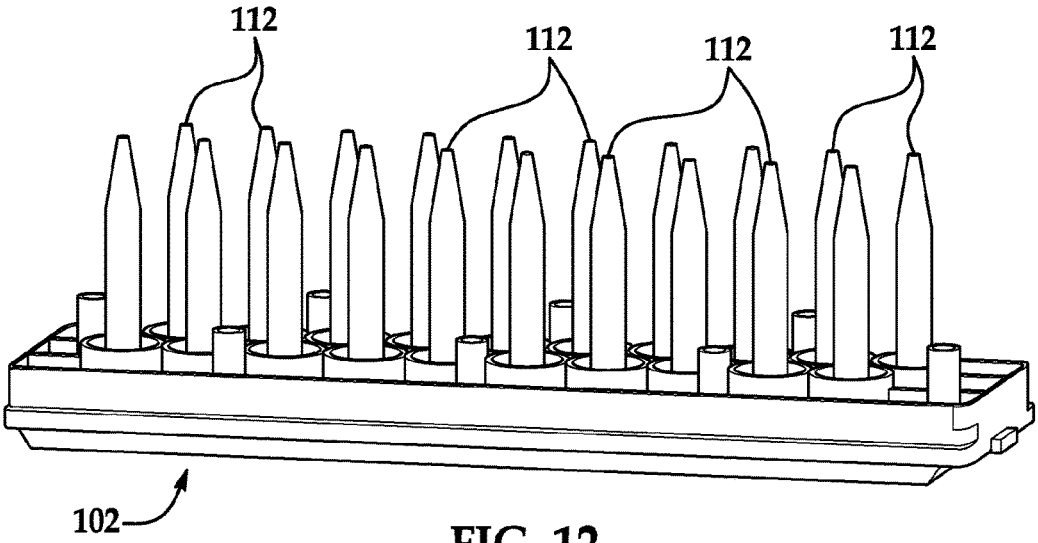
FIG. 12 is a perspective view of a portion of the magazine.
Figure 12A:
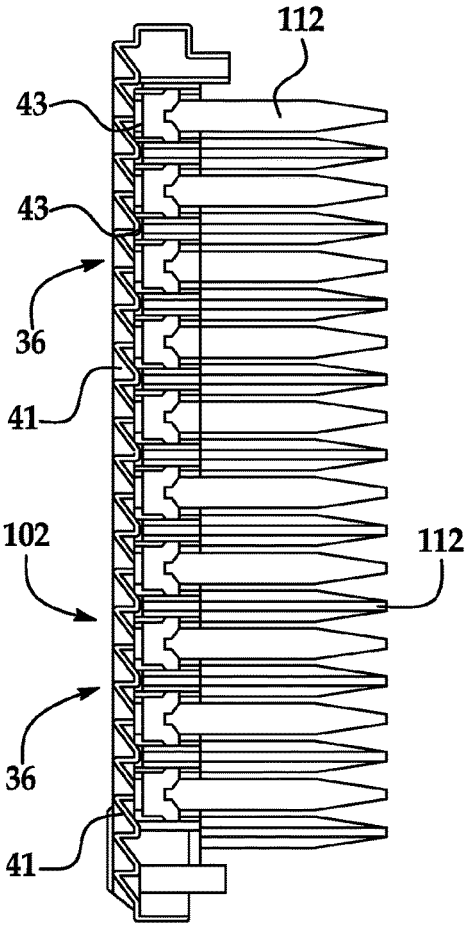
FIG. 12A is a side view of the portion of the magazine in FIG. 12.

Referring to FIG. 12A, each of the notches 36 has a pair of walls that form the particular notch 36. As shown, each notch 36 is formed with one wall that is substantially perpendicular to the back surface of the back body portion 102 and another wall that is angled or tapered relative to the base surface of the back body portion 102. The angled wall forms an angled portion 41 of the notch 36 and the perpendicular wall forms a flat portion 43 of the notch 36. As the advancing member 34 of the toy blaster 10 protrudes into the notch 36, it engages the angled wall surface 41 and slides therealong until it reaches the intersection of the perpendicular wall and the angled wall forming notch 36. The advancing member 34 engages the flat portion 43 to move the magazine 30 in the direction of arrow 45. The advancing member 34 is reciprocated by the operating mechanism of the toy blaster 10.

Notches 37 are configured to define openings into which spring-biased mechanism 39, such as a plunger or projection, is received. Notches 37 are positioned to receive spring biased mechanism 39 therein such that opening 26 is aligned fluidly coupled with nozzle 24. Accordingly, compressed air or fluid can be directed into one of chambers 28 via an opening 46. The pair of walls that form each notch 37 are symmetrical, which results in the spring-biased mechanism 39 engaging each of the walls of notch 37 the same, thereby seating in the center of the notch 37. The notches 37 are used to position the magazine 30 in proper alignment with the air source.

The rows of advancement notches 36 and alignment notches 37 are located on the same surface of the magazine 30. This arrangement simplifies the functioning of the toy blaster 10 and magazine 30 because the components that perform the functions of advancing and aligning the magazine 30 can be located proximate to each other and on the same side of the magazine 30. This configuration simplifies the operation and performance of those functions as they are driven by the toy blaster 10.

Figure 12B:
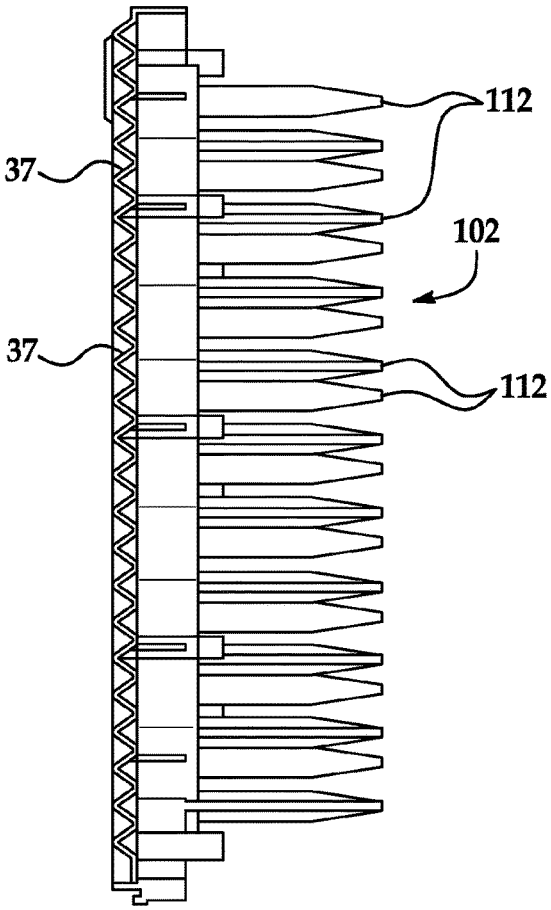
FIG. 12B is a cross-sectional view of the portion of the magazine in FIG. 12.

FIGS. 12A and 12B are cross-sectional views of back body portion 102 illustrating the aforementioned notches 36 and 37. Also shown is that back body portion 102 is configured to have a plurality of protruding members 112. Each of the protruding members is configured to be received within the body of one of the plurality of projectiles 22 when the projectiles 22 are inserted into the chamber 28. Protruding members 112 are configured to align the projectiles 22 as they are inserted into chambers 28.

Figure 6:
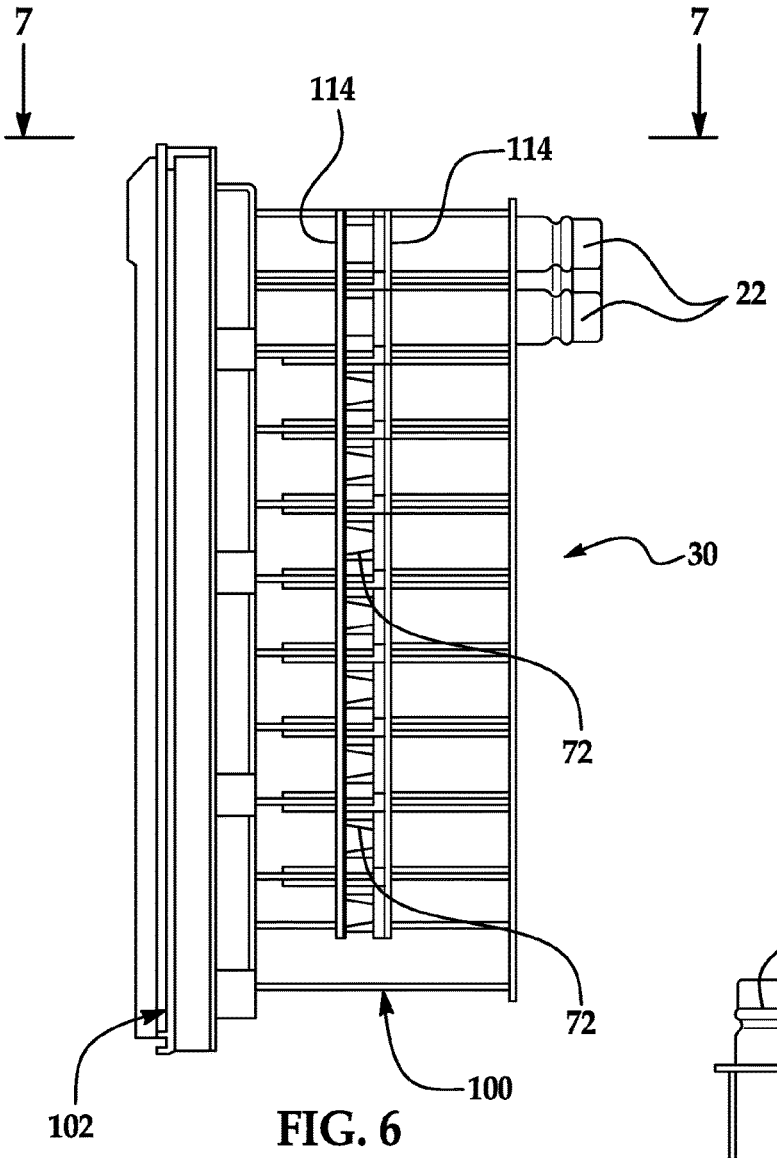
FIG. 6 is a side view of the magazine in FIG. 5.
Figure 7:
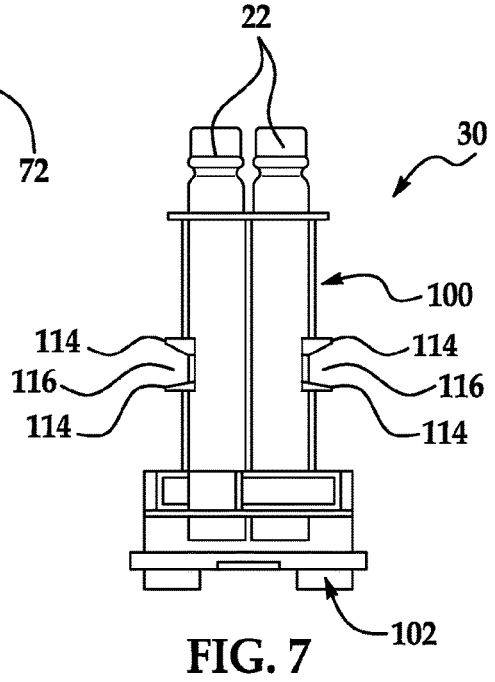
FIG. 7 is a view along lines 7-7 of FIG. 6.
Figure 9B:
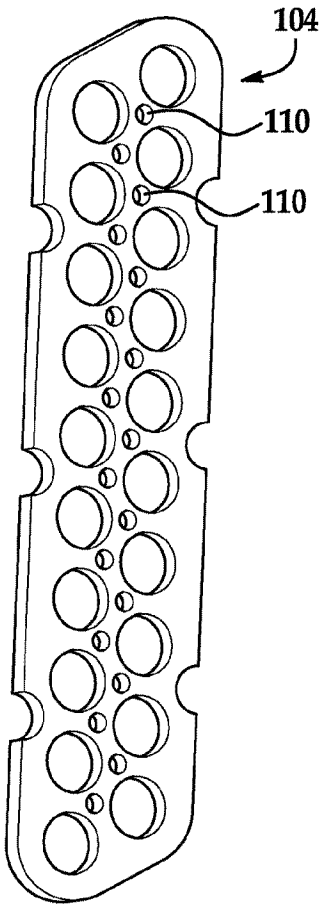
FIGS. 9A and 9B are views of components of the magazine.
Figure 9A:
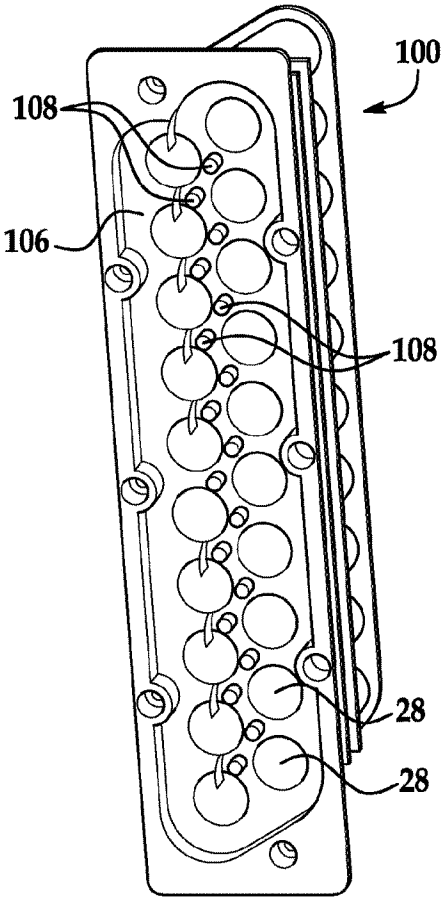

As illustrated in at least FIGS. 6 and 7, slots or openings 72 are located within a pair of wall members 114, at least one of which has a chamfered or angled surface 116, which is configured to direct contact portions 44 and 48 into openings or slot 72 as the magazine 30 moves with respect to the housing 12 of the toy 10 such that the safety mechanism 38 remains constantly in contact with the magazine and functions by contacting an outer surface of projectile 22 when it is inserted into the chamber 28.

Also shown is that slots or openings 72 are located on either side of magazine 30. In addition, chambers 28 of magazine 30 are located in an offset manner so that the overall width "W" of the magazine may be reduced while also allowing each of the plurality of chambers 28 to be fluidly coupled to at least one of the openings 46 located on back body portion 102.

In accordance with one non-limiting exemplary embodiment, magazine 30 and/or blaster 10 or components thereof, may be formed from an easily moldable material such as plastic. Of course, other materials and combinations thereof are contemplated to be within the scope of various embodiments of the present invention.

Figure 13:
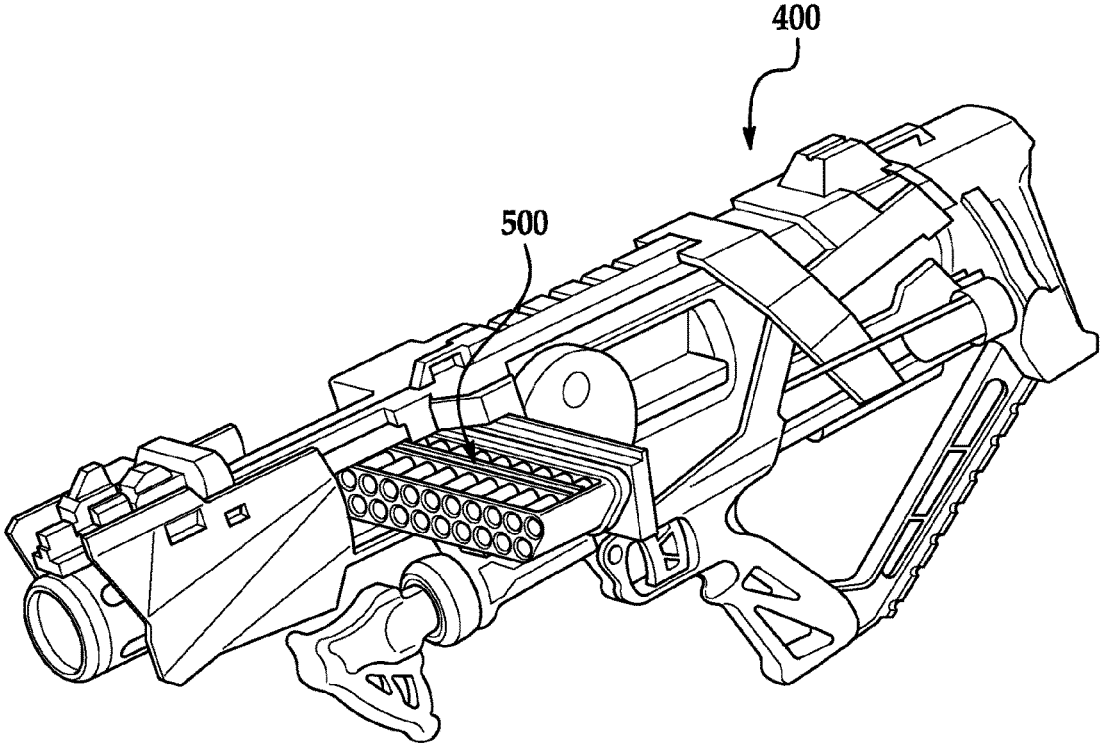
FIG. 13 is a perspective view of an alternative embodiment of a launching device according to the present invention.

An alternative embodiment of a toy blaster and magazine according to the present invention is illustrated in FIG. 13. In this embodiment, the toy blaster 400 functions generally similar to toy blaster 10 and the magazine 500 interacts with the toy blaster 400 in a manner similar to magazine 30 with respect to toy blaster 10.

Figure 14:
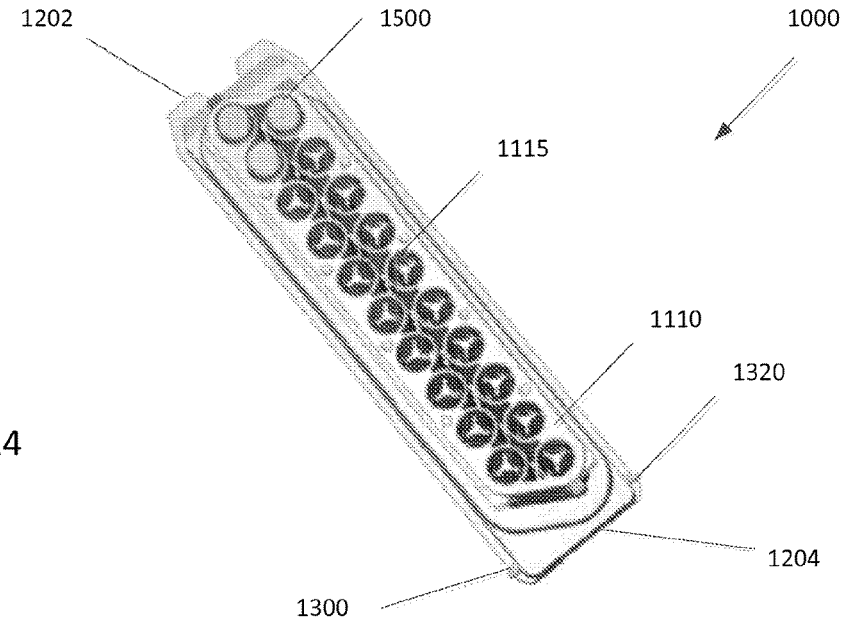
FIG. 14 is a top view of an alternative embodiment of a magazine according to the present invention.
Figure 15:
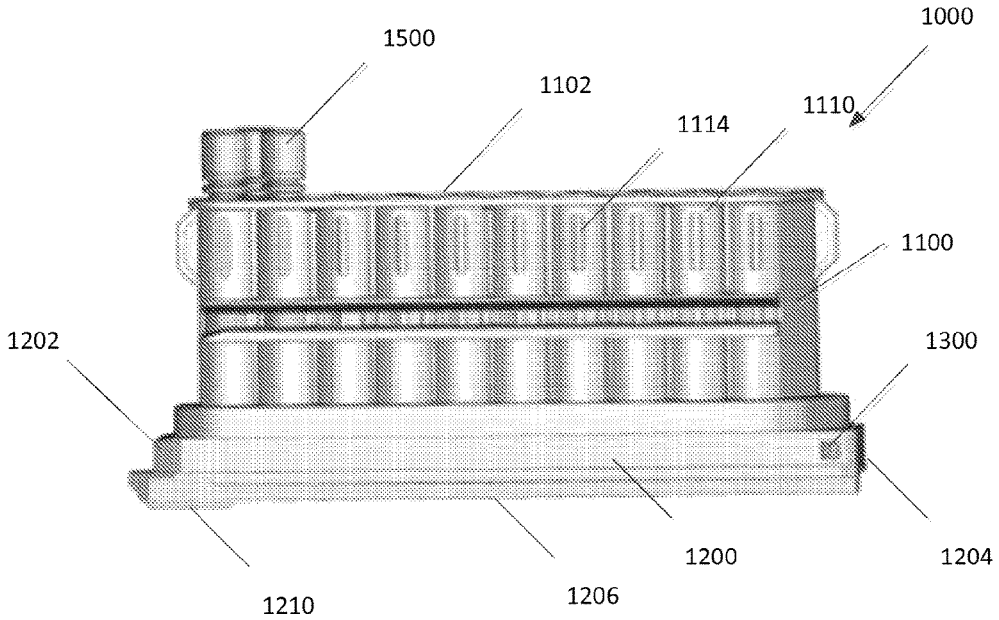
FIG. 15 is a side view of the magazine in FIG. 14.
Figure 16:
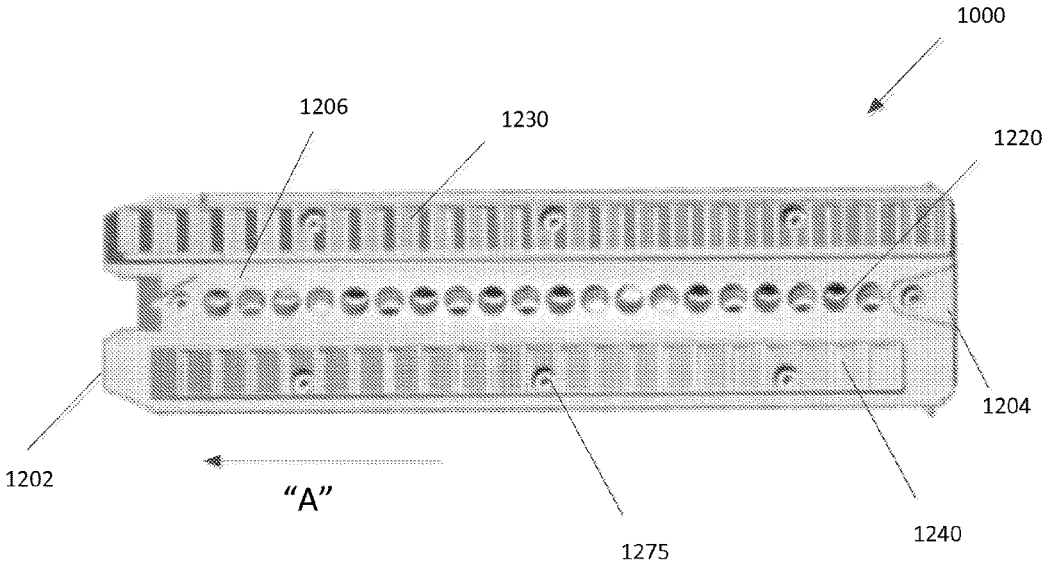
FIG. 16 is a bottom view of the magazine in FIG. 14.

An alternative embodiment of a magazine according to the present invention is illustrated in FIGS. 14-21. Referring to FIGS. 14-16, the magazine 1000 includes a main body portion 1100 and a lower portion 1200 that is coupled to the main body portion 1100 via several couplers 1275 (see FIG. 16), such as screws. The main body portion 1100 includes a wall 1110 that defines several cavities or chambers 1115 into which projectiles 1500 may be inserted, as shown. The cavities 1115 extend through the main body portion 1100 from the upper end 1102 to the end of the main body portion 1100 proximate to the lower portion 1200.

As shown in FIG. 15, each cavity or chamber 1115 has a slot 1114 formed in the outer portion of the wall 1110 that defines the cavity 1115. The slot 1114 extends through the wall 1110.

The lower portion 1200 has a back surface 1206 that extends from a first end 1202 to a second end 1204 opposite to the first end 1202. The lower portion 1200 engages with the housing of a toy projectile launcher. The first end 1202 has tapered portions that facilitate the insertion of the magazine 1000 into the housing. A tab 1210 extends from the back surface 1206 and engages a groove formed on the housing of the projectile launcher. Referring to FIG. 16, the back surface 1206 also includes a line of through holes 1220 and rows of recesses 1230 and 1240. The advancing recesses 1240 are located on one side of the center holes 1220 and the alignment recesses 1230 are located on the other side. Accordingly, the magazine 1000 is to be inserted with end 1202 entering an opening of the housing first. Thus, magazine 1000 is to be inserted along the direction of arrow "A" (see FIG. 16) so that the advancing recesses 1240 are aligned and engageable with the alignment mechanism and the alignment recesses 1230 are aligned and engageable with the spring-biased alignment mechanism of the projectile launcher. If the magazine 1000 is inserted with end 1204 entering the housing first, the recesses 1230 and 1240 will not be aligned with the proper mechanism on the housing.

To prevent the improper loading of the magazine 1000, stops or limiters 1300 and 1320 are coupled to the magazine body and located at opposite corners of end 1204 of the lower portion 1200 (see FIGS. 14 and 16). The stops 1300 and 1320 ensure that a user does not insert end 1204 first into the toy projectile launcher. The stops 1300 and 1320 are mounted to the lower portion 1200 so that they move inwardly when the magazine 1000 is inserted and advanced in a proper direction and they abut a portions of the projectile launcher housing when a user attempts to insert end 1204 first.

Figure 17:
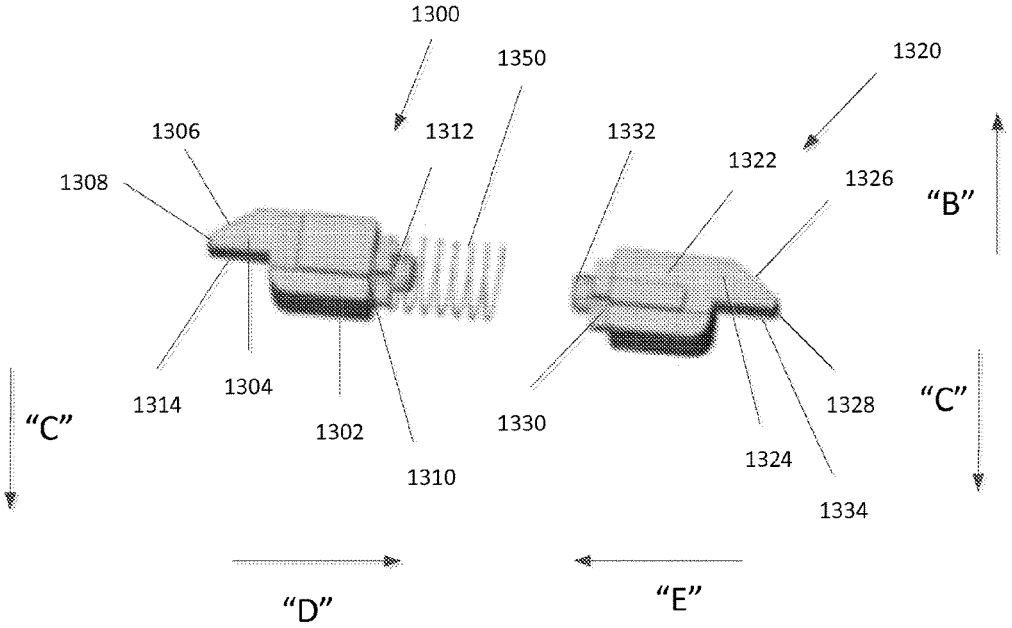
FIG. 17 is a perspective view of the stops of the magazine in FIG. 14.
Figure 18:
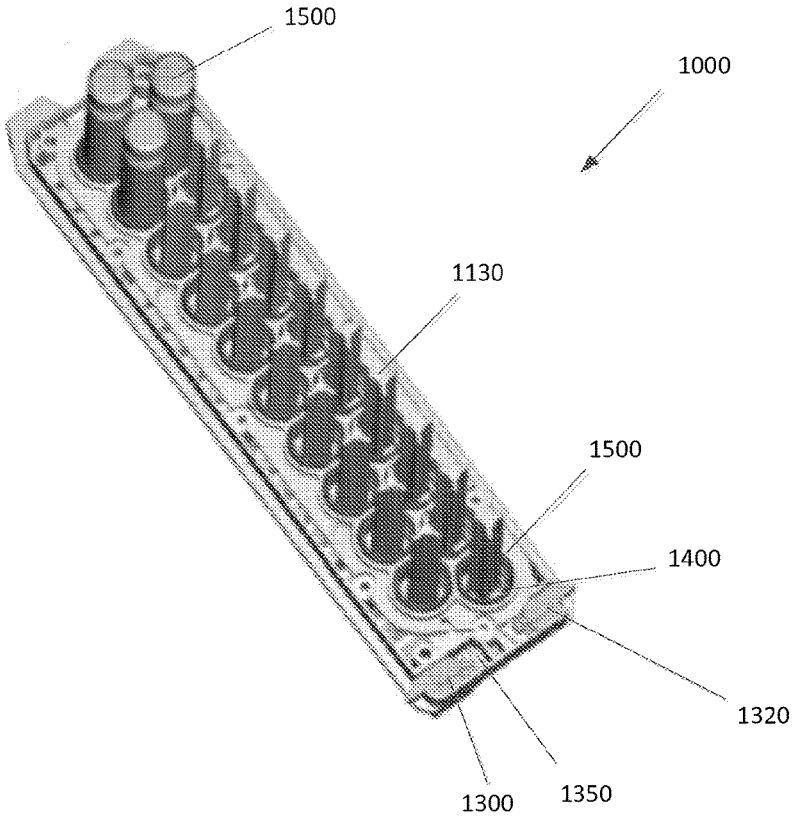
FIG. 18 is a perspective view of some components of the magazine in FIG. 14.

Referring to FIGS. 17 and 18, the stops 1300 and 1320 are illustrated in their operative configuration. In this embodiment, stop 1300 includes a body 1302 with a tab or tab portion 1304 having an end 1308 and a tapered or angled engagement surface 1306. The body 1302 includes a surface 1310 from which a post or protrusion 1312 extends. Similarly, stop 1320 includes a body 1322 with a tab or tab portion 1324 having an end 1328 and an angled engagement surface 1326. The body 1322 includes a surface 1330 from which a post or protrusion 1332 extends. A spring 1350 is positioned so that the spring 1350 extends over the protrusions 1312 and 1332 and provides a biasing force on surfaces 1310 and 1330, thereby biasing the stops 1300 and 1320 away from each other.

When the magazine 1000 is inserted into and moves relative to the projectile launcher along the direction of arrow "B," edges of the housing of the projectile launcher engage surfaces 1306 and 1336 along the direction of arrows "C." This engagement of surfaces 1306 and 1336 causes the stops 1300 and 1320 to move inwardly against the bias of the spring 1350 along the directions of arrows "D" and "E." If the magazine 1000 is inserted in a direction opposite to arrow "B," the edges of the projectile launcher housing will engage stop surfaces 1314 and 1334. The engagement of surfaces 1314 and 1334 does not result in the stops 1300 and 1320 moving, and thus, the stops 1300 and 1320 prevent the advancement of the magazine 1000 relative to the projectile launcher in the improper direction.

Referring to FIG. 18, the upper or main body portion 1100 is removed from the magazine 1000. As shown, the lower portion 1200 includes projections 1130 that extend into the bodies of the darts 1500. In this embodiment, the magazine 1000 includes a gasket 1500 that is placed on another gasket 1400.

Figure 19:
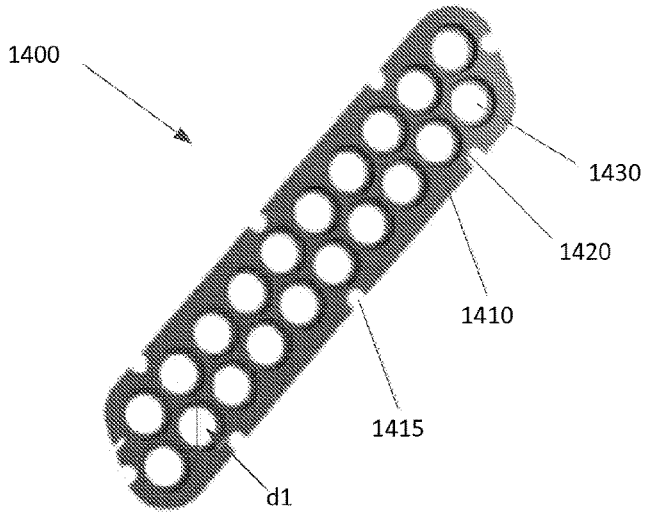
FIG. 19 is a top view of a gasket of the magazine in FIG. 14.
Figure 20:
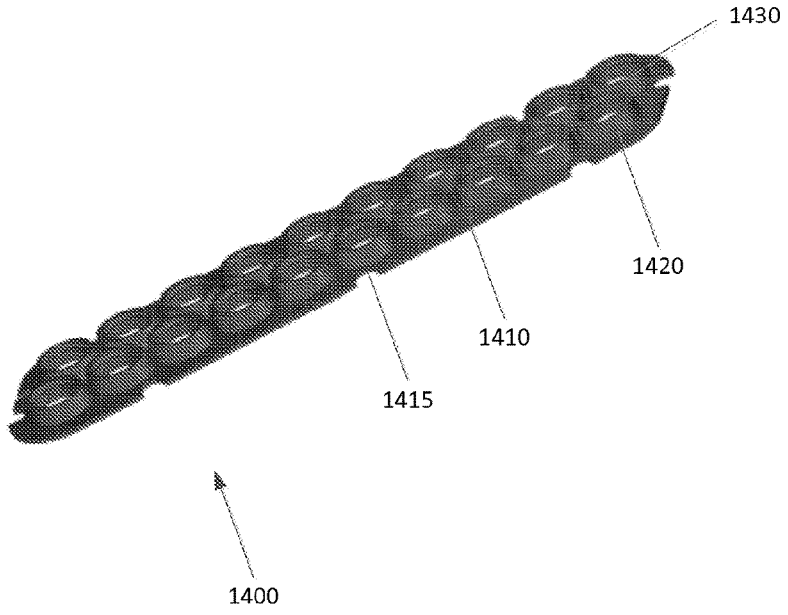
FIG. 20 is a perspective view of the gasket in FIG. 19.

Referring to FIGS. 19 and 20, gasket 1400 is illustrated in top and perspective views. As shown, the gasket 1400 includes a plate or body portion 1410 with several notches 1415 along its perimeter which provides clearance for the coupling of the main body portion 1100 and the lower portion 1200. Spaced along the length of the plate 1410 are several cylinder or cylindrical portions or sleeves 1420, each of which defines a through hole 1430. The through holes 1430 correspond to the chambers 1112 defined by the main body portion 1100 and have a diameter that is represented by d1.

Figure 21:
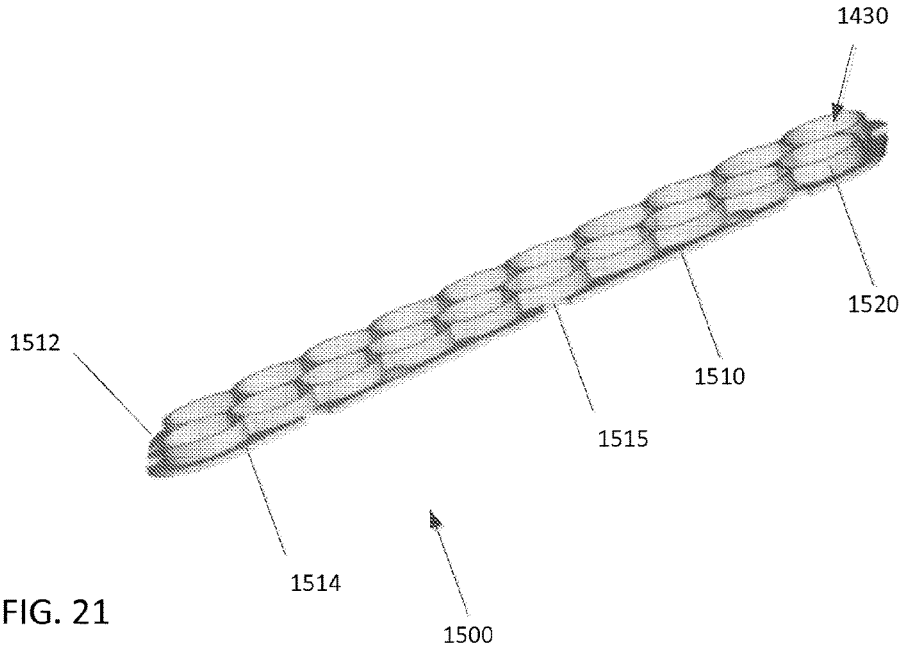
FIG. 21 is a perspective view of another gasket of the magazine in FIG. 14.
Figure 22:
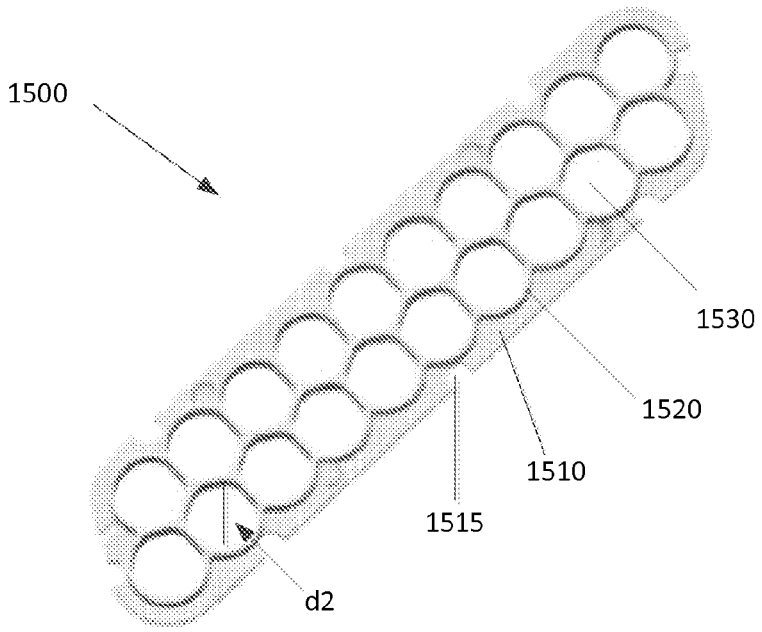
FIG. 22 is a top view of the gasket in FIG. 21.

Referring to FIGS. 21 and 22, a perspective view and a top view of gasket 1500 are illustrated. In this embodiment, gasket 1500 includes a plate 1510 with notches 1515 and cylindrical portions or sleeves 1520 defining holes 1530. The diameter of the holes 1530 is represented by d2, which is slightly larger than the d1 dimension, thereby allowing the gasket 1500 to be placed on gasket 1400 with sleeves 1430 being inserted into sleeves 1530. Gasket 1500 includes an upper surface 1512 and a back or lower surface 1514.

The use of multiple gaskets improves the sealing of the chambers and the overall functioning of the device. The slightly tapered configuration and relative dimensions of the sleeves allow them to be inserted into the lower ends of the chambers 1112, thereby providing a seal.

In alternative embodiments, the appearance and functioning of the toy projectile launcher used with the magazine according to the invention can vary. Each of the alternative embodiments may include a spring-biased mechanism that engages the magazine and an advancing mechanism as well.

In addition, and in one non-limiting embodiment, projectiles 22 may be constructed in accordance with the teachings of U.S. patent application Ser. No. 13/838,900 filed, Mar. 15, 2013 the contents of which are incorporated herein by reference thereto. In one non-limiting exemplary embodiment, the dart or projectile 22 has an elongated tubular body portion which has a forward end or front end and a rearward end. The rearward or rear end has an opening that extends into the opening of the elongated tubular body portion and the front end has a blunt soft tip secured thereto.

Some exemplary embodiments of the invention include:

A toy configured to launch a plurality of projectiles therefrom, the toy having: a magazine movably secured to a housing of the toy, the magazine being configured to hold the plurality of the projectiles therein; a source of compressed air, wherein the source of compressed air of the toy is fluidly coupled to the magazine; and a safety mechanism for preventing the fluid coupling of the source of compressed air to the magazine.

The toy as set for the above, wherein the magazine has a main body portion, which is secured to a back body portion.

The toy as set for the above, wherein a gasket is located between the main body portion and the back body portion.

The toy as set for the above, wherein the main body portion has a receiving area configured to receive the gasket.

The toy as set for the above, wherein the back body portion has a first plurality of features that are configured to engage an advancing member of the toy in order to cause corresponding movement of magazine with respect to the housing of the toy.

The toy as set for the above, wherein the back body portion has a second plurality of features that are also located on back body portion, the second plurality of features are configured to receive a spring biased mechanism of the toy therein, wherein the spring biased mechanism is configured to locate magazine with respect to the toy such that a nozzle of the toy is fluidly coupled to one of a plurality of openings located between the first plurality of features and the second plurality of features.

The toy as set for the above, wherein each of the plurality of first features has an angled portion that terminates at a flat portion, wherein the angled portion is configured to allow the advancing member to slide a surface of the angled portion and engage the flat portion in order to move the magazine with respect to the toy.

The toy as set for the above, wherein the back body portion is configured to have a plurality of protruding members each being configured to be received within one of the plurality of projectiles when they are inserted into one of a plurality of chambers of the magazine.

The toy as set for the above, wherein the protruding members are configured to receive and align the projectiles as they are inserted into one of the plurality of chambers.

The toy as set for the above, wherein the magazine has a plurality of openings configured to allow a portion of the safety mechanism to contact a projectile when it is inserted into one of a plurality of chambers of the magazine.

The toy as set for the above, wherein the plurality of openings are located on either side of a main body portion of the magazine.

The toy as set for the above, wherein the plurality of openings are located within a pair of walls that extend outwardly from a main body portion of the magazine.

The toy as set for the above, wherein at least one of the pair of walls has an angled surface to guide a portion of the safety mechanism into one of the plurality of openings.

The toy as set for the above, wherein the plurality of openings are located on either side of a main body portion of the magazine.

The toy as set for the above, wherein the magazine has a plurality of chambers each one of which is configured to receive one of the plurality of projectiles therein, wherein the plurality of projectiles are arranged into two columns each being offset from the other.

The toy as set for the above, wherein the magazine has a plurality of openings configured to allow a portion of the safety mechanism to contact a projectile when it is inserted into one of the plurality of chambers of the magazine.

A magazine configured to removably receive a plurality of projectiles therein and configured for use with a toy configured to launch the plurality of projectiles therefrom, the magazine comprising: a main body portion, which is secured to a back body portion and wherein the back body portion has a first plurality of features and a second plurality of features located on opposite sides of a plurality of openings, wherein each one of the plurality of openings is fluidly connected to at least one of a plurality of chambers of the magazine, wherein each one of the plurality of chambers is configured to receive one of the plurality of projectiles therein.

The magazine as set for the above, wherein the plurality of chambers are arranged into two columns each being offset from the other.

The magazine as set for the above, further comprising a plurality of openings located on opposite sides of a main body portion of the magazine.

The magazine as set for the above, further comprising a pair of sidewalls located on either side of each one of the plurality of openings located on opposite sides of the main body portion of the magazine.

As used herein, the terms "first," "second,"—and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

The modifier "about" used in connection with a quantity is inclusive of the stated value and has the meaning dictated by the context (e.g., includes the degree of error associated with measurement of the particular quantity).

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A toy projectile launcher configured to launch a plurality of projectiles therefrom, the toy projectile launcher comprising:

a housing; and a magazine movably secured to a housing of the toy projectile launcher, the magazine including a plurality of chambers, each of the chambers being configured to hold one of the plurality of the projectiles therein, the magazine having a surface that is engageable by the toy projectile launcher to align and to move the magazine relative to the housing;

wherein the magazine has a main body portion and a back body portion, the main body portion being coupled to the back body portion; and wherein the toy projectile launcher includes an advancing member, and the back body portion has a first plurality of recesses that are engageable by the advancing member to cause movement of the magazine relative to the housing.

2. The toy projectile launcher as recited in claim 1, wherein the magazine further comprises a gasket located between the main body portion and the hack body portion.

3. The toy projectile launcher as recited in claim 2, wherein the main body portion has a receiving area, the gasket being located in the receiving area.

4. The toy projectile launcher as recited in claim 1, wherein the back body portion has a second plurality of recesses formed therein spaced apart from the first plurality of recesses.

5. The toy projectile launcher as recited in claim 4, wherein the toy projectile launcher includes a spring-biased mechanism, the second plurality of recesses being configured to receive the spring-biased mechanism, the spring-biased mechanism locating the magazine with respect to the housing such that a nozzle of the toy projectile launcher is fluidly coupled to one of a plurality of openings located between the first plurality of recesses and the second plurality of recesses.

6. The toy projectile launcher as recited in claim 4, wherein each of the plurality of first recesses has an angled position that terminates at a fiat portion, the angled portion being configured to allow the advancing member to slide along a surface of the angled portion and engage the flat portion in order to move the magazine with respect to the housing.

7. The toy projectile launcher as recited in claim 1, wherein the back body portion includes a plurality of protruding members, each of the protruding members being received within one of the plurality of projectiles when the projectiles are inserted into the chambers of the magazine.

8. The toy projectile launcher as recited in claim 1, wherein the chambers are arranged into two columns, and the columns are offset from each other.

9. The toy projectile launcher as recited in claim 1, wherein the magazine includes a plurality of through holes formed therein, and each of the chambers is coupled to one of the holes.

10. The toy projectile launcher as recited in claim 9, wherein the holes are located in a line.

11. The toy projectile launcher as recited in claim 10, wherein the holes are located between a pair of lines of recesses.

12. A magazine for a toy projectile launcher configured to launch a plurality of projectiles therefrom, the magazine comprising:

a main body portion including walls defining a plurality of chambers, each of the chambers being configured in hold the plurality of the projectiles therein; and a back body portion coupled to the main body portion, the back body portion being engageable by the toy projectile launcher to move the magazine;

wherein the back body portion includes a first row of recesses that are engageable by an advancing member of the toy projectile launcher, and a second row of recesses that are engageable by a locating member of the toy projectile launcher.

13. The magazine as recited in claim 12, wherein the magazine includes a plurality of through holes formed therein, each of the chambers is coupled to one of the holes, and the holes are located between the two rows of recesses.

14. The magazine as recited in claim 12, wherein the chambers are arranged into two columns, and the columns are offset from each other.

15. A magazine configured to removably receive a plurality of projectiles therein and configured for use with a toy projectile launcher configured to launch the plurality of projectiles therefrom, the magazine comprising:

a main body portion, which is secured to a back body portion and wherein the back body portion has a first plurality of features and a second plurality of features located on opposite sides of a plurality of openings, wherein each one of the plurality of openings is fluidly connected to at least one of a plurality of chambers of the magazine, wherein each one of the plurality of chambers is configured to receive one of the plurality of projectiles therein.

16. The magazine as recited in claim 15, wherein the chambers are arranged into two columns each being offset from the other.

17. The magazine as recited in claim 16, wherein adjacent chambers share common walls.

* * * * *